United States Patent [19]

Minoprio et al.

[11] 4,069,404

[45] Jan. 17, 1978

[54] SLIDABLE SWITCH USABLE WITH A PORTABLE WARNING LAMP

[75] Inventors: William Edward Minoprio, Blackburn; Arthur Kenneth Horsfield, Preston, both of England

[73] Assignee: Dorman Smith Traffic Products Limited, Southport, England

[21] Appl. No.: 714,106

[22] Filed: Aug. 13, 1976

[51] Int. Cl.[2] ..... F21V 23/04

[52] U.S. Cl. ..... 200/60; 200/16 D; 200/42 R; 340/81 R; 340/114 B; 362/200

[58] Field of Search ..... 240/10.65, 10.6 SD, 240/10.63, 10.68, 11.2 R, 22, 23, 10.66, 10.6 R; 200/42 R, 60, 16 C, 16 D; 340/81 R, 114 R, 114 B, 331

[56] References Cited

U.S. PATENT DOCUMENTS

| | | | |
|---|---|---|---|
| 1,375,586 | 4/1921 | Graves | 240/10.66 |
| 1,590,541 | 6/1926 | Päiviö | 240/10.65 |
| 2,344,175 | 3/1944 | Shannon | 240/10.63 |
| 2,800,601 | 7/1957 | Martin et al. | 340/81 R |
| 3,266,015 | 8/1966 | Pickering | 340/81 R |
| 3,274,382 | 9/1966 | Fattori | 200/60 X |
| 3,500,378 | 3/1970 | Pickering et al. | 340/331 |

*Primary Examiner*—R. L. Moses

*Attorney, Agent, or Firm*—Ross, Ross & Flavin

[57] ABSTRACT

A battery-powered lamp, such as a traffic hazard warning lamp has:

a. a casing formed with ledges for location thereon of the bottom edges of the batteries to retain the batteries in the casing, a fixing bolt, extending through the casing, serving to prevent disengagement of the batteries from the ledges;

b. said casing having apertures in two opposite sidewalls, each said apertures accommodating a respective lens which is a tight friction fit therein and may have ratchet-like teeth engaging with the material of the casing to retain the lens in position; and c. a switch in the form of a terminal strip engaged by terminals of the batteries, said strip being longitudinally slidable and having a bridging portion which is in or out of register with a stationary contact according to the position of the strip.

11 Claims, 6 Drawing Figures

SLIDABLE SWITCH USABLE WITH A PORTABLE WARNING LAMP

This invention concerns battery-powered lamps, more particularly lamps of the kind comprising a casing housing one or more high-capacity batteries (such as so-called "lantern batteries"), a lens structure being mounted on the casing, and the casing being constructed for a bolt to extend therethrough to enable the lamp to be mounted on a support such as a tripod, barrier, bracket or the like. Such lamps are used, for example, as road hazard warning lamps, for airfield illumination and for like purposes.

Often, such lamps have casings made of moulded plastics materials, use of plastics having hitherto been more economical than other traditional materials. However, more recently, the costs of plastics materials has increased substantially and it is desirable therefore, for economies to be achieved if at all possible to avoid excessive increases in manufacturing costs and, consequently, in selling prices.

As hitherto proposed, the casings of such lamps generally comprise a hollow body part which accommodates the battery or batteries, as well as a removable base part or closure which is held in position by the bolt and which, when in position, serves to retain the battery or batteries. The present invention is based upon the appreciation that considerable saving of costs can be achieved if the lamp can be designed so as not to require a base part or closure for the body part, in that the cost of one component can be obviated, and that by simplification of the configuration of the body part, this can, if desired, be made of common metal such as steel which is relatively less expensive than plastics at the present time.

Pursuant hereto, the present invention provides, as a first feature, a battery-powered lamp of the kind having a casing comprising a box-like body part which houses one or more batteries and which is constructed for a belt to extend therethrough to enable the lamp to be mounted on a support such as a tripod, characterised in that said body part is shaped to have an opening for insertion of the battery or batteries therein, and has one or more ledges, shoulders or other retaining protuberances for the battery or batteries to engage therewith and thereby to be retained in the casing, the bolt serving to locate said battery or batteries against disengagement from the retaining protuberances.

With such arrangement, of course, it is not necessary to provide a separate base part or closure for the casing, since retention of the battery or batteries is achieved by the combination of the retaining protuberances and the bolt.

In the event of the body part being made of a plastics material, the ledges, shoulders or other retaining protuberances may be moulded integrally therein.

The body part may, however, conveniently be made of sheet metal (e.g. sheet steel) in which case the retaining protuberances may be provided by one or more lips or tongues formed by pressing out or bending over one or more portions of the material of the body part, or by one or more pegs secured to or through the walls of the body part or by respective angle members secured to the respective inner walls of the casing.

The lamp of the invention may be designed to be powered by and for its casing to accommodate only a single battery or more than two batteries, for example four "lantern" batteries.

The lamp of the present invention may be further characterised in that the casing accommodates a light source and has one or more lenses set in a wall or walls of the body part thereof, for trnasmission of light from the or each said lens, which is preferably of a rigid plastics material having a peripheral rim by which it is a friction fit in a respective complementary opening in the respective wall of the casing body part.

With such a construction, therefore, for fitting the or each lens in place it is only necessary to press the lens into its respective opening, the operations of securing the lens into a surrounding frame and the frame into the wall of the casing all being completely eliminated.

Preferably the or each opening is formed with an inwardly-directed peripheral rim with which the rim of the lens engages frictionally.

The or each lens preferably has a surrounding flange or lip outside its rim, to define the possible depth of insertion of the lens into its opening.

To ensure that the or each lens cannot fall out of its opening or become dislodged therefrom, the or each lens preferably has, on its peripheral rim, a plurality of ratchet-like teeth which, upon insertion of the or each lens into its respective opening, locate behind the material of the respective wall of the casing to resist removal of the lens from its opening.

The teeth, of which there are conveniently three, are preferably of triangular configuration being formed integrally with the rim of the lens, the triangular configuration thereof serving to ensure that the teeth locate behind the material of the respective wall of the lamp then to resist removal of the lens from its opening, the material surrounding which is conveniently recessed inwardly of the lamp.

The or each lens is, of course, preferably circular, but other configurations, such as hexagonal, octagonal or square are, of course, possible.

The lamp of the invention may be further characterised in that it incorporates an electrical switch assembly comprising a support carrying a conducting protuberance, and a slidable conductive strip member mounted for longitudinal sliding movement relative to said support and having a bridge portion disposed to register with and form a bridge over said protuberance to provide an "off" condition of the switch, in which there is no contact between the slidable strip member and the protuberance, longitudinal movement of the slidable strip member serving to bring said slidable strip member, adjacent to the bridge portion thereof, into contact with the protuberance to provide an "on" condition of the switch.

The bridge portion may, of course, be formed in the slidable strip member by a recess of niche being cut out of the said strip member. In a particularly advantageous embodiment, however, the said bridge portion is constituted by an arched or joggled portion formed by bending the strip member.

The support may be provided by a carrier member which serves the practical function of carrying a number of components (of which the switch constitutes one) of the lamp.

The carrier member may, then, carry a bulb holder, and if desired appropriate flashing circuitry connected with said bulb holder; and the slidable strip member may constitute one of two conductive terminal strips, which may be carried by the carrier member, so as to be engageable by corresponding terminals of the battery or batteries.

The casing of the lamp conveniently has restricted openings, at opposed locations, permitting access to the respective ends of the slidable strip member, e.g. by means of a thin rod, prong or like element, for displacing said strip member by pressure applied to the one or the other of said ends.

Said ends of the slidable strip member may be bent so as to extend approximately perpendicular to the plane of the strip member.

The invention will be described further, by way of example, with reference to the accompanying drawings, in which:

FIG. 1 is a perspective view illustrating a preferred embodiment of lamp according to the present invention;

FIG 2. is an underneath plan, to an enlarged scale, of the lamp of FIG. 1;

Figure 1:
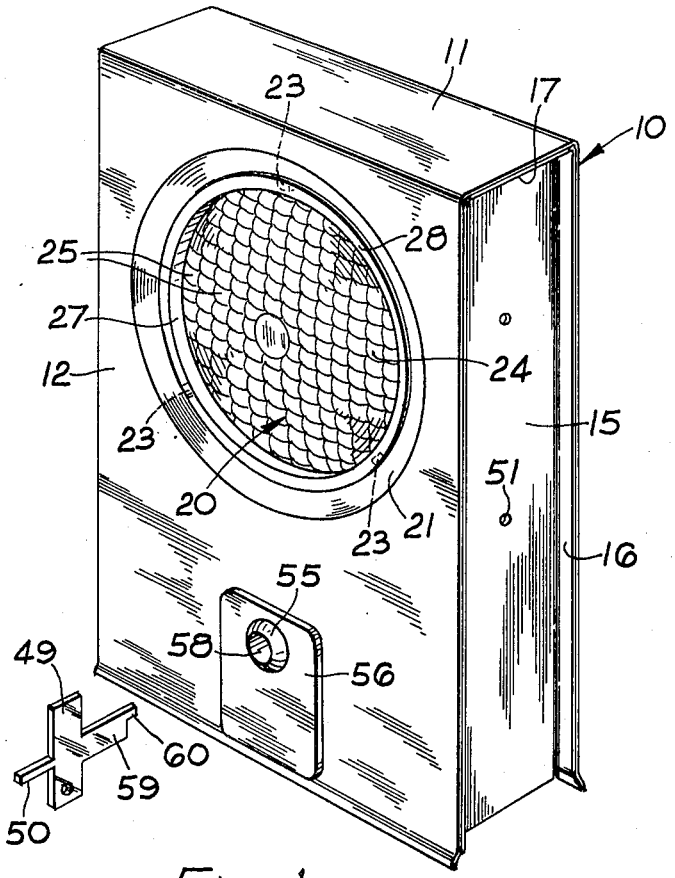
Figure 2:
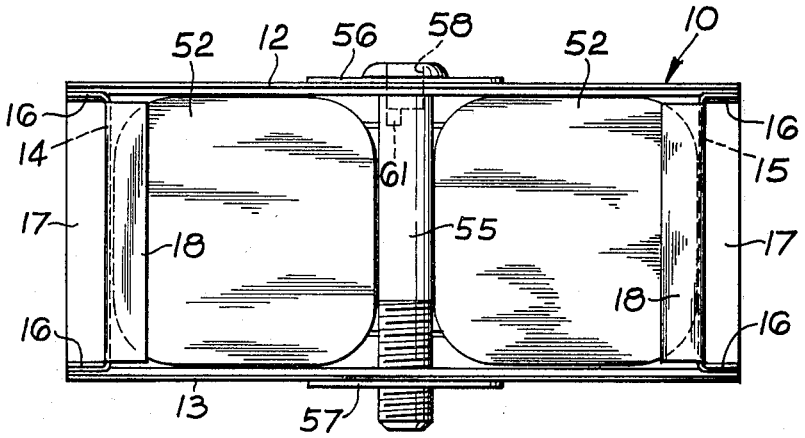

The illustrated embodiment of the lamp of the invention is a road hazard warning lamp and comprises a generally rectangular box-like casing 10 made of sheet metal. This comprises a top wall 11 connected at opposite edges respectively to a front wall 12 and a rear wall 13 of the casing, these three walls 11, 12, 13 being integral with one another and being formed by appropriately bonding a flat element of sheet metal. Rectangular side gussets 14 and 15 having side flanges 16 and top flanges 17 are located between the front and rear walls 12 and 13, being secured in place by welding or brazing said flanges 16, 17 to the top, front and rear walls 11, 12, 13 as appropriate. The side gussets 14, 15 constitute inset side members of the casing 10 which, as will be understood from the various figures, is open-bottomed.

Along their bottom edges, at the open bottom of the casing, the side gussets 14, 15 have respective inturned lips or tongues 18 which define respective ledges or protuberances on the inner surface of the side walls, provided by the side gussets 14, 15 of the casing 10.

Figure 5:
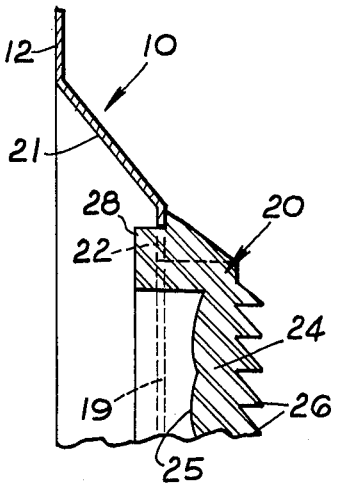
FIG. 5 is an enlarged fragmentary sectional detail illustrating how the lenses of the lamp of FIGS. 1 to 4 are retained in place.

Towards the top of the casing, the front and rear walls 12, 13 are each formed with a respective opening 19 into which a respective circular lens 20 is located. Each of these openings 19 is formed in a respective inwardly-pressed surrounding portion 21 of the front and rear walls 12, 13 respectively, these portions 21 circumscribing respective circumferential rims 22, and each such rim 22 has three equiangularly-spaced radial notches 23 therein. Each lens 20 comprises a central light-transmitting portion 24, formed at one side with cushions 25 and at the other side with concentric tooth-like ridges 26, with grooves therebetween, as can be seen in FIG. 5 of the drawings, this central portion 24 being surrounded by an approximately cylindrical rim 27 and formed with a flange or lip 28 which determines the depth of insertion of the lenses 20 into their openings 19. Three equispaced pawl-like teeth 29 are provided on the cylindrical rim 27 and these correspond with the respective notches 23 so that upon each lens 20 being pressed firmly into its respective opening 19, these teeth 28 snap behind the circumferential rim 22 of the respective wall 12 or 13 to ensure that the lenses 20 cannot unintentionally be removed from the front and rear walls 12, 13.

When fitting the lenses 20, each such lens 20 is simply pressed into its respective aperture 19, the rim 27 on the lens being a tight friction fit in the rim 22 around the respective aperture 19. As the lens 20 is pressed in, the tooth 29 on its rim 27 eventually snap behind the material of the respective panel of the lamp, the flange or lip 28 limiting the depth by which the lens 20 can be pressed in, by abutting the outer surface of the respective front or rear panel of the casing of the lamp. The engagement of the teeth with the material of the panel is effective to prevent the lenses from becoming disengaged from their apertures, since such teeth engage firmly with the inner surface of the material of the panel around the respective opening in the event of the lens tending to move outwardly of the aperture.

Figure 6:
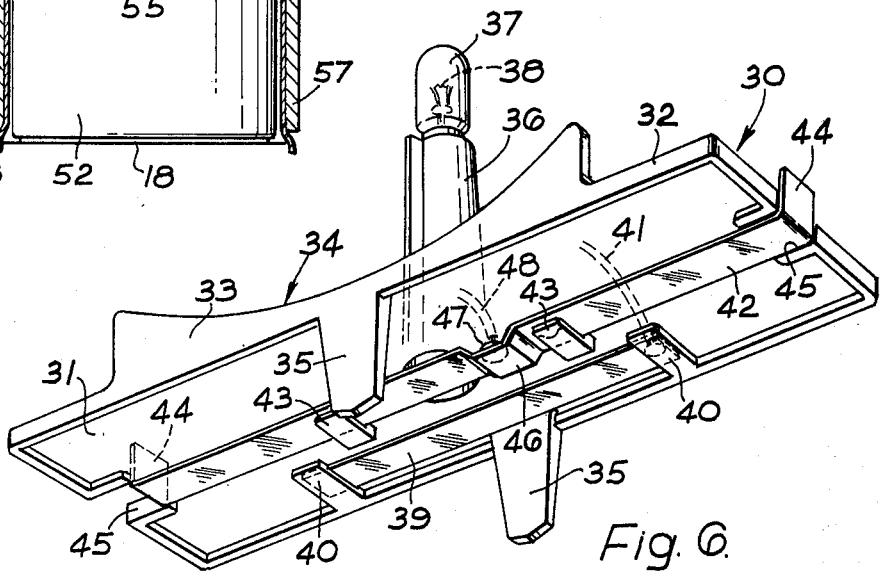
FIG. 6 is an underneath perspective view illustrating a carrier member forming part of the lamp of FIGS. 1 to 5.

A carrier member 30, which is illustrated in detail in FIG. 6, is accommodated in the casing 10 immediately below the lowermost parts of the lenses 20. This carrier member 30 comprises basically a plate-like or board-like element 31 stiffened by a thickening 32 around its outer edge and dimensioned so as to fit with a clearance, within the casing 10, substantially parallel to the top wall 11. Along the two opposite lower sides of the element 31 are two integral locating projections 33 which present respective arcuate locating edges 34 to the lenses 20, the curvatures of these edges 34 being complementary to the outer curvatures of the rims 27 of the lenses 20 so that the carrier member 30 can be located relative to the lenses 20 by the locating edges 34 engaging with the respective rims 27.

Two battery-spacing fingers 35, the function of which will be described later, are formed integrally with the element 31 so as to project from the latter, at the side remote from the projections 32, substantially midway along the two longitudinal edges of said element 31.

Projecting substantially centrally from the element 31, between the projections 32 is a post-like bulb holder 36 into which fits a low-voltage bulb 37, the height of the holder 36 being such that when the carrier 30 is in position with the projections 33 locating with the lenses 20, filament 38 of the bulb 37 is in accurate register with the optical axes of the lenses 20, and optimum transmission by the lenses 20 of light from the bulb 37 will be achieved. It will readily be understood that since the locating edges 34, whereby the carrier member 30 is located relative to the lenses 20, is arcuate and complementary to the outer curved surfaces of the lenses, the filament 38 will be properly located at the optical axes of the lenses 20 even if the carrier member 30 is not absolutely parallel to the top wall 11.

On its underside the element 31 carriers, adjacent one longitudinal edge, a fixed terminal strip 39 which is held in place by retainers 40 integrally-moulded with the element 31. A lead 41 connects by one end to the terminal strip 39 and by its other end to an appropriate pole of the bulb holder 36.

Additionally, extending longitudinally of the element 31, substantially along the longitudinal center line thereof is a movable terminal trip 42 which serves also as a switch member for the lamp. This strip 42 is held to the underside of the element 31, whilst being slidable relative to the latter, by two L-shaped retainers 43, and has, at its two ends, upwardly-bent tabs 44 which locate in or register with notches 45 provided in each end of the element 31. It will readily be understood that the tabs 44 serve to determine the extent by which the movable terminal strip 42 can be displaced.

Figure 3:
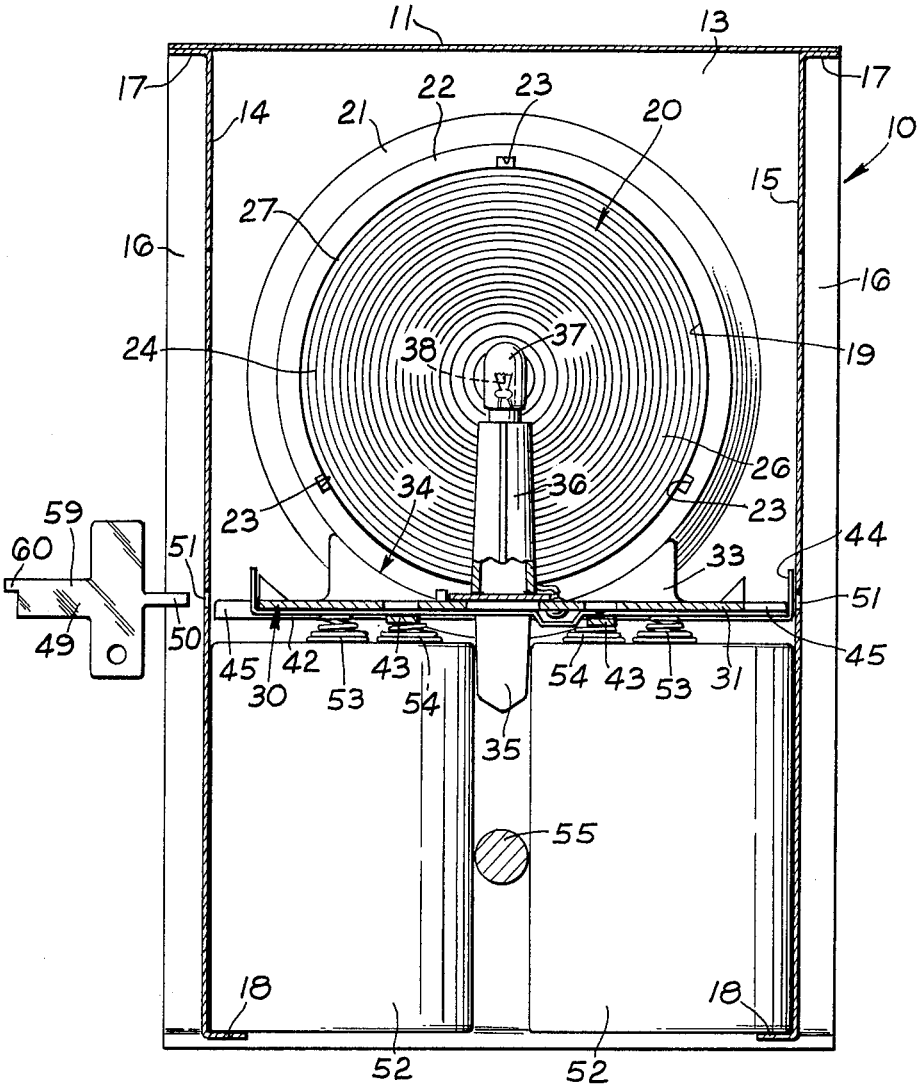
FIG. 3 is a sectional front elevation of the lamp of FIGS. 1 and 2, to the same scale as FIG. 2.
Figure 4:
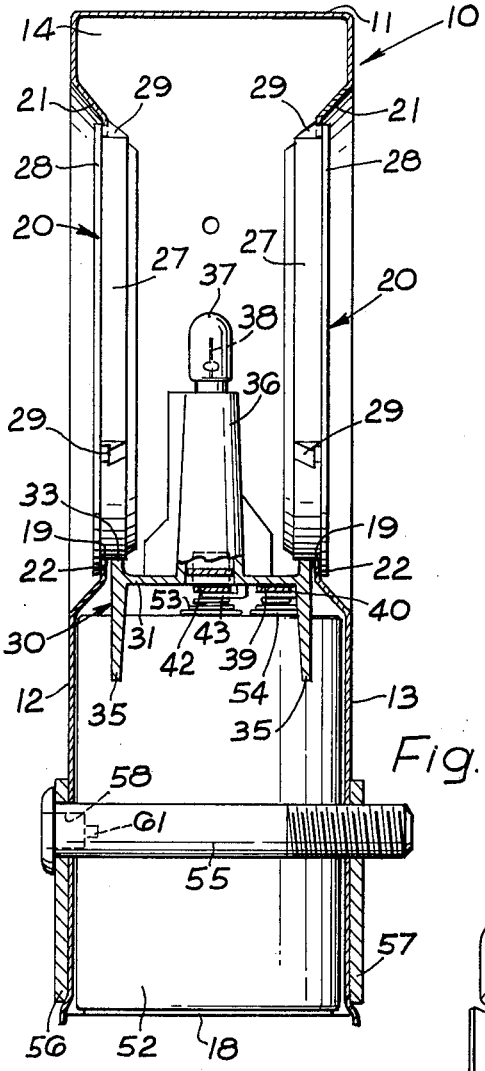
FIG. 4 is a sectional side elevation of the lamp of FIGS. 1, 2 and 3.

As can be seen from FIG. 6, the terminal strip 42 has a bridge portion 46 formed therein by appropriate bonding, and this is shown, in both FIGS. 3 and 6, in an off position in which it bridges a contact 47 in the form, for example, of a blob of solder, this contact 47 being connected, by way of a respective lead 48 (if desired with the interposition of appropriate circuitry to ensure flashing of the bulb 37) to the other pole of the bulb holder 36. In the event of the strip 42 being displaced longitudinally (e.g. by means of a tool 49 having a narrow prong 50 (see FIGS. 1 and 3) inserted through the appropriate one of two holes 51 to engage with one of the two tabs 44, the bridge portion 46 can be brought out of register with the contact 47 which then contacts with the strip 42 which is then in its "on" position.

The carrier member 30 serves to define, in the lower part of the casing 10, a battery compartment which, as shown in the drawing, is occupied by two so-called "lantern" batteries 52 each having two spiral resilient wire terminals 53 and 54 of which the terminal 53 is centrally disposed in the top of each battery 52 and therefore engages with the movable terminal strip 42, whilst the terminal 54 is disposed towards one corner of the top of the respective battery and engages with the fixed terminal strip 39. The batteries 52 are, therefore, connected in parallel with the bulb 37 in the bulb holder 38 and current to the bulb 37 can be switched on or off by appropriate movement of the strip 42 as already described.

At their upper ends, the batteries 52 locate one to each side of the battery-spacing fingers 35 of the underside of the carrier member 30, and it will be appreciated from FIG. 3 that upon insertion of the batteries 52 (which is effected on at a time with bolt 55 removed) each battery 52 has to be engaged, by its bottom edge, with a respective one of the two lips or tongues 18, by appropriate lateral movements of the bottom parts of the batteries 52. When in position located with said lips or tongues 18, the batteries 52 serve to retain the carrier member 30 in place by the terminals 53, 54 thereof loading the carrier member 30 resiliently towards the lenses 20 so as to locate with the latter by the locating projections 33.

The bolt 55 extends through a hole in the front wall 12 of the casing 10, and a registering hole in a reinforcing plate 56 secured to said front wall 12, and threadedly engages into a corresponding hole in the rear wall 13 and a similar reinforcing plate 57 secured to said rear wall 13. Rotation of the bolt 55 for inserting it in place or removing it can be effected by insertion, into a recess 58 in its head, tongue 59 of the tool 50, which tongue 59 has an offset tooth 60 which engages into an eccentric depression 61 at the bottom of the recess 58. The bolt 55 can, if desired, be used for securing the lamp to a support, such as an upright post, barricade, tripod or the like.

From the foregoing, it will readily be understood that once the batteries 52 have been inserted in their positions, and the bolt 55 has been screwed in place, removal of the batteries is not possible. The bolt 55 keeps the batteries in engagement with the lips or tongues 18 and they cannot be disengaged from said lips or tongues for removal from the casing until the bolt 55 is removed. In turn, this cannot be effected by anyone not in possession of an appropriate tool 49 for unscrewing the bolt 55, since this cannot be unscrewed using conventional tools.

It will also readily be understood that the preferred embodiment of the lamp of the invention, as described, is composed of a minimum of components and accordingly is relatively inexpensive to manufacture. Assembly of the components is easy, in that the carrier member 30 simply has to be inserted into the casing 10 the right way up and then pressed into its correct position by subsequent fitting of the batteries which remain in place simply by resting on the lips or tongues 18 whilst the bolt 55 is being inserted and tightened.

The terminal strip 42 has to be present, of course, for engagement therewith of the respective terminals of the batteries, and by making this strip 42 displaceable and so as to cooperate with the contact 47 as described, the need for the provision of a separate switch arrangement is avoided and a consequential cost saving is achieved.

The invention is not confined, of course, to the foregoing example, and variations may be made thereto. For instance, the ledge or protuberance arrangement which serves, in conjunction with the bolt 55, for retaining the batteries 52 in position may be executed in various ways differing from what has been illustrated. Thus, instead of the ledges or protuberances being provided by the bentover lips or tongues 18, they could be provided by separate angle members, secured to the inner surfaces of the side walls of the casing, e.g. by welding or brazing, or by pegs or tongues which are secured into the project through the sidewalls of the casing. The casing could, of course, be formed by moulding from a suitable plastics material in which event the ledges or like protuberances can be moulded integrally or can be incorporated by way of moulded-in steps or shoulders. It is not essential that the casing should both accommodate the lenses and the batteries, and the casing could, if desired, be in two parts, connected together, of which one part is provided by or is fitted with the lenses and the other part accommodates the batteries.

Insofar as the switch arrangement, provided by the displaceable terminal strip 42, is concerned, it will readily be understood that alternative means, differing from what has been described, may be provided for displacing the strip 42, and, therefore, switching on and off, for instance involving a pivotable dolly or rotatable knob.

The mode of operation of the switch assembly comprising the slidable strip member 42 and the conducting protuberance or contact 47 bridged by the bridge portion 46 of the slidable strip member 42 will readily be understood from the foregoing description. Whilst the bridge portion 46 of the slidable strip 42 actually bridges the protuberance 47, the switch assembly is in an "off" or open condition and no current passes to the bulb in the bulb holder. When the lamp is required to be switched on, the user takes the tool 49 and inserts it by its prong 50 into an appropriate one of the two openings 51 in the side walls of the casing, thereby to engage the corresponding end 44 of the slidable strip member 42 and to slide the latter relative to the carrier (and the resilient contacts of the battery) until it contacts the protuberance. This gives an "on" or closed condition of the switch assembly, at which current is provided to the bulb by way of the flasher circuit.

For switching off, the prong 50 is inserted into the other of the openings to engage the other end of the slidable strip and displace the latter back to its "off" position.

It will readily be appreciated from the above description that the switch assembly of the invention is obtained in an extremely simple and inexpensive manner. It would be necessary to provide the two terminal strips for engagement by the battery contacts in any event, and the switch assembly is obtained by the simple expedient of making one of these strips movable, and engageable with and disengageable from, the conductive protuberance.

It will readily be understood also that the invention can be applied to any construction of lamp involving one or more lenses set into a generally flat panel of a casing of the lamp and such lamp need not be battery-powered but could, for example, be a paraffin lamp. Of course, as already stated the lenses do not have to be circular; they can be of any practical shape, for example, square, hexagonal or octagonal, although a circular configuration is usually to be preferred.

We claim:

1. An electric lamp having a switch assembly comprising a support carrying a conducting protuberance, and a slidable conductive strip member mounted for longitudinal sliding movement relative to said support and having a bridge portion disposed to register with and form a bridge over said protuberance to provide an "off" condition of the switch, in which there is no contact between the slidable strip member and the protuberance, longitudinal movement of the slidable strip member serving to bring said slidable strip member, adjacent to the bridge portion thereof, into contact with the protuberance to provide an "on" condition of the switch.

2. A lamp as claimed in claim 1 wherein the conducting protuberance is in the form of a blob of solder to which a lead is connected.

3. A lamp as claimed in claim 1 wherein the bridge portion is formed in the slidable strip member by a recess or niche being cut out of said strip member.

4. A lamp as claimed in claim 1 wherein the bridge portion is constituted by an arched or joggled portion formed by bending the strip member.

5. A lamp as claimed in claim 1 wherein the support is provided by a carrier member which serves the practical function of carrying a number of components in a piece of electrical equipment.

6. A lamp as claimed in claim 5 wherein the carrier member carries a bulb holder.

7. A lamp as claimed in claim 6 wherein the carrier member also carries appropriate flashing circuitry connected to the bulb holder.

8. A lamp as claimed in claim 1 wherein the slidable strip member constitutes one of two conductive terminal strips engageable by corresponding terminals of one or more batteries.

9. A lamp as claimed in claim 8 wherein the said one of the terminal strips is carried by the carrier member.

10. A lamp as claimed in claim 1 and comprising a casing having restricted openings, at opposed locations, permitting access to the respective ends of the slidable strip member for displacing it.

11. A lamp as claimed in claim 10 further including a tool, having a thin rod, prong or like element, for insertion into holes in the casing, or the like, e.g. for moving the strip between its on and off positions.

* * * * *